US011125467B2

(12) United States Patent
Alsadah

(10) Patent No.: US 11,125,467 B2
(45) **Date of Patent: *Sep. 21, 2021**

(54) APPARATUS FOR WATER TEMPERATURE REGULATION

(71) Applicant: KING FAHD UNIVERSITY OF PETROLEUM AND MINERALS, Dhahran (SA)

(72) Inventor: Jihad Hassan Alsadah, Safwa (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 5 days.

This patent is subject to a terminal disclaimer.

(21) Appl. No.: 16/393,669

(22) Filed: Apr. 24, 2019

(65) Prior Publication Data

US 2019/0249901 A1 Aug. 15, 2019

Related U.S. Application Data

(63) Continuation of application No. 15/335,939, filed on Oct. 27, 2016, now Pat. No. 10,323,859.

(51) Int. Cl.
*F24H 4/04* (2006.01)
*F24D 17/02* (2006.01)
(Continued)

(52) U.S. Cl.
CPC ..... *F24H 4/04* (2013.01); *E03C 1/044* (2013.01); *F24D 17/02* (2013.01);
(Continued)

(58) Field of Classification Search
CPC ... F24H 1/10; F24H 1/12; F24H 1/122; F24H 4/04; F24H 1/50; F24D 17/02; F24D 17/0031
See application file for complete search history.

(56) References Cited

U.S. PATENT DOCUMENTS 849,317 A * 4/1907 Blanchard ..... F24D 17/0031 126/53
2,117,907 A * 5/1938 Ogden ..... E03B 7/08 137/337

(Continued)

OTHER PUBLICATIONS

"Heat Pump Water Heaters (HPWHs)". Energy Star, https://www.energystar.gov/index.cfm?c=heat_pump.pr_how_it_works Jun. 3, 2015, 1 page.

*Primary Examiner* — Nelson J Nieves
(74) *Attorney, Agent, or Firm* — Oblon, McClelland, Maier & Neustadt, L.L.P.

(57) ABSTRACT

A water mixing system attached to an existing plumbing system supplying ambient temperature water and providing temperature regulated water to a user. The water mixing system includes an insulated water tank, a heat pump connected to the insulated water tank with a heat rejecting radiator inside the insulated water tank and a heat absorbing radiator outside the insulated water tank, a temperature detector in the insulated water tank, and one outlet of the insulated water tank connected to a first inlet of a first dispensing water tank. Having a second inlet to receive the ambient temperature water from the existing plumbing system and at least one dispensing outlet, the first dispensing water tank provides mixed water of a desirable temperature from heated water from the insulated water tank and the ambient temperature water via control of the valves attached to the first inlet and the second inlet.

13 Claims, 6 Drawing Sheets

(51) Int. Cl.
*F24D 19/10* (2006.01)
*E03C 1/044* (2006.01)

(52) U.S. Cl.
CPC .... *F24D 19/1054* (2013.01); *F24D 2200/123* (2013.01); *F24D 2220/0235* (2013.01); *F24D 2220/08* (2013.01)

(56) References Cited

U.S. PATENT DOCUMENTS 4,037,786 A * 7/1977 Munroe ..... F28D 21/0007 237/19
4,241,588 A * 12/1980 Murphy ..... F24D 17/02 165/901
4,382,368 A * 5/1983 Dittell ..... F24D 17/02 62/238.6
4,570,449 A * 2/1986 Knokey ..... F24D 17/02 62/183
4,633,676 A * 1/1987 Dittell ..... F24D 11/0214 62/238.6
4,809,594 A * 3/1989 Vitous ..... A47J 31/002 426/433
4,901,915 A * 2/1990 Sakakibara ..... G05D 23/1393 236/12.12
5,979,775 A 11/1999 Raya
7,195,176 B2 * 3/2007 Newman ..... F28D 20/0034 236/20 R
7,316,267 B2 1/2008 Kunimoto et al.
7,672,576 B2 * 3/2010 Grossbach ..... F24D 17/0031 392/463
7,827,814 B2 11/2010 Slater
7,866,168 B2 1/2011 Gordon et al.
8,147,117 B2 4/2012 Drewry et al.
8,465,650 B2 6/2013 McCague et al.
8,567,689 B2 10/2013 Eisenhower et al.
2008/0228249 A1 9/2008 Barnitz
2010/0031953 A1 * 2/2010 Penev ..... F24D 19/106 126/615
2010/0096018 A1 * 4/2010 Wylie ..... F24H 1/122 137/2
2010/0209084 A1 * 8/2010 Nelson ..... F24D 19/1054 392/465
2010/0257882 A1 * 10/2010 Penev ..... F24D 17/02 62/235.1
2011/0259560 A1 * 10/2011 Kinoshita ..... F24H 9/2007 165/138
2011/0305444 A1 * 12/2011 Pussell ..... F24H 9/2028 392/308
2012/0152232 A1 6/2012 Pedersen
2012/0255507 A1 * 10/2012 Fushiki ..... F24D 19/1051 122/19.1
2013/0319348 A1 * 12/2013 Hughes ..... F24H 1/12 122/18.2
2014/0202549 A1 * 7/2014 Hazzard ..... F24H 1/185 137/3
2014/0260358 A1 * 9/2014 Leete ..... F24D 19/1054 62/79
2016/0341445 A1 * 11/2016 Deivasigamani ..... F24H 1/08
2018/0010822 A1 * 1/2018 Trant ..... F24H 9/2021
2018/0238561 A1 * 8/2018 Yin ..... F24D 17/02

* cited by examiner

APPARATUS FOR WATER TEMPERATURE REGULATION

CROSS-REFERENCE TO RELATED APPLICATIONS

The present application is a Continuation of Ser. No. 15/335,939, having a filing date of Oct. 27, 2016, now allowed.

BACKGROUND OF THE INVENTION

Technical Field

The present disclosure relates to a water mixing system receiving ambient temperature water from an existing plumbing system and providing temperature regulated water to a user. More specifically, the present disclosure relates to a water mixing system with a heat pump connected to an insulated water tank to heat or cool ambient temperature water and mix the heated or cooled water with the ambient temperature water to provide temperature regulated water to a user.

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, is neither expressly nor impliedly admitted as prior art against the present invention.

The temperature of water from an existing plumbing system, such as municipal water, can reach uncomfortable levels in regions of extreme climate. For example, municipal water provided to residential buildings in Saudi Arabia may reach a temperature as high as 50-55° C. in summer and as low as 10-15° C. in winter. Existing solutions include cooling a main tank containing hot municipal water with fans or closed cycle refrigeration, or heating a main tank containing cold municipal water with an electrical heater. These solutions are energy intensive and wasteful, since the main tank is usually not insulated or poorly insulated, and since some of the water from the main tank is used for purposes that do not require temperature regulated water, such as the water for gardening, washing, and filling of a toilet.

It is thus an object of this disclosure to provide water mixing systems with a heat pump connected to an insulated water tank to heat or cool ambient temperature water and mix the heated or cooled water with the ambient temperature water to provide temperature regulated water to a user.

BRIEF SUMMARY OF THE INVENTION

According to a first aspect, the present disclosure relates to a water mixing system, for attaching to an existing plumbing system having a supply of ambient temperature water, and providing temperature regulated water to a user. The water mixing system includes an insulated water tank having a first inlet to receive the supply of ambient temperature water, a valve attached to the first inlet of the insulated water tank for altering a water flow therefrom, a first heat pump connected to the insulated water tank, wherein the first heat pump has at least one heat rejecting radiator and a heat absorbing radiator, wherein a first heat rejecting radiator is located inside the insulated water tank to heat water inside the insulated water tank and the heat absorbing radiator is located outside the insulated water tank, a first temperature detector for detecting the temperature of the water inside the insulated water tank, a first outlet attached to the insulated water tank, wherein the first outlet is connected to a first dispensing water tank via a first inlet, wherein the first dispensing water tank has a tank bottom and a tank interior capable of holding water and is attached to the existing plumbing system via a second inlet to receive the supply of ambient temperature water, a pair of valves attached to the first inlet and the second inlet of the first dispensing water tank for altering a water flow therefrom and adjusting the temperature of water in the first dispensing water tank, a second temperature detector for detecting the temperature of the water in the first dispensing water tank, and a plurality of outlets attached to the first dispensing water tank, wherein at least one of the outlets is for dispensing the water to the user.

In one or more embodiments, the first dispensing water tank further comprises a desired temperature control for allowing the user to set a desired water temperature, and the pair of valves attached to the first inlet and the second inlet of the first dispensing water tank are solenoid valves which automatically adjust the water flow through the first inlet and the second inlet to achieve the desired water temperature within the first dispensing water tank.

In one or more embodiments, the first dispensing water tank further comprises a water level indicator for indicating a water level inside of the first dispensing water tank to the user.

In one or more embodiments, the plurality of outlets attached to the first dispensing water tank includes at least one side outlet which is located above the tank bottom of the first dispensing water tank, so that the at least one side outlet allows a reserve supply of water to collect in the first dispensing water tank which cannot be drained by the at least one side outlet.

In one or more embodiments, the plurality of outlets includes at least one outlet which is located at the tank bottom of the first dispensing water tank that is capable of draining the reserve supply from the first dispensing water tank.

In one or more embodiments, the water mixing system further comprises a first water pump for delivering water from the first dispensing water tank to the insulated water tank and at least one pipe for connecting the first dispensing water tank to the insulated water tank.

In one or more embodiments, the water mixing system further comprises a control for operating the first dispensing water tank in a reheat mode at which water from the first dispensing water tank is returned to the insulated water tank to be reheated through the first water pump and the at least one pipe. The control monitors the temperature of the water in the first dispensing water tank, and the control operates the first water pump to return the water in the first dispensing water tank to the insulated water tank when the temperature of the water in the first dispensing water tank is below a pre-determined level.

In one or more embodiments, the control further opens the first inlet of the first dispensing water tank to add water from the insulated water tank to the first dispensing water tank, and the control stops operation of the first water pump and closes the first inlet of the first dispensing water tank when the temperature of the water in the first dispensing water tank reaches or exceeds the pre-determined level.

In one or more embodiments, the water mixing system further comprises a second water pump for delivering water from the first dispensing water tank to a heat exchanger that heats the water, and at least one pipe for connecting the first dispensing water tank to the heat exchanger.

In one or more embodiments, the water mixing system further comprises a second water pump for delivering water from the first dispensing water tank to a heat exchanger that heats the water, and at least one pipe for connecting the first dispensing water tank to the heat exchanger. The heated water from the heat exchanger is delivered to the first dispensing water tank.

In one or more embodiments, the water mixing system further comprises a second water pump for delivering water from the first dispensing water tank to a heat exchanger that heats the water, and at least one pipe for connecting the first dispensing water tank to the heat exchanger. The heat exchanger comprises a second heat rejecting radiator of the first heat pump connected to the insulated water tank.

In one or more embodiments, the water mixing system further comprises a second water pump for delivering water from the first dispensing water tank to a heat exchanger that heats the water, at least one pipe for connecting the first dispensing water tank to the heat exchanger, and a control for operating the first dispensing water tank in a reheat mode at which water from the first dispensing water tank is brought to the heat exchanger to be reheated through the second water pump and the at least one pipe. The control monitors the temperature of the water in the first dispensing water tank, operates the second water pump to pass the water in the first dispensing water lank to the heat exchanger and/or the heat exchanger when the temperature of the water in the first dispensing water tank is below a pre-determined level, and stops operation of the second water pump and/or the heat exchanger when the temperature of the water in the first dispensing water tank reaches or exceeds the pre-determined level.

In one or more embodiments, the water mixing system further comprises a second dispensing water tank, wherein the second dispensing water tank has a first inlet connected to one of the plurality of outlets attached to the first dispensing water tank to receive water from the first dispensing water tank, and wherein the second dispensing water tank has a second inlet attached to the existing plumbing system to receive the supply of ambient temperature water and at least one outlet for dispensing water within the second dispensing water tank to the user.

In one or more embodiments, the second dispensing water tank is further connected to the insulated water tank via at least one pipe to receive water from the insulated water tank.

In one or more embodiments, the water mixing system includes an insulated water tank having a first inlet to receive the supply of ambient temperature water, a valve attached to the first inlet of the insulated water tank for altering a water flow therefrom, a first heat pump connected to the insulated water tank, wherein the first heat pump has at least one heat rejecting radiator and a heat absorbing radiator, wherein a first heat rejecting radiator is located inside the insulated water tank to heat water inside the insulated water tank and the heat absorbing radiator is located outside the insulated water tank, a first temperature detector for detecting the temperature of the water inside the insulated water tank, a first outlet attached to the insulated water tank, a mixer, wherein the mixer is connected to the first outlet attached to the insulated water tank to receive the heated water from the insulated water tank, the existing plumbing system to receive the supply of ambient temperature water, and an inlet of a first dispensing water tank, wherein the mixer mixes the heated water with the ambient temperature water and supplies the mixed water to the first dispensing water tank via the inlet of the first dispensing water tank, and wherein the first dispensing water tank has a tank bottom and a tank interior capable of holding water, a second temperature detector for detecting the temperature of the mixed water in the first dispensing water tank, and a plurality of outlets attached to the first dispensing water tank, wherein at least one of the outlets is for dispensing the water to the user.

According to a second aspect, the present disclosure relates to a water mixing system, for attaching to an existing plumbing system having a supply of ambient temperature water and providing temperature regulated water to a user. The water mixing system includes an insulated water tank having a first inlet to receive the supply of ambient temperature water and a second inlet, a valve attached to the first inlet of the insulated water tank for altering a water flow therefrom, a first outlet attached to the insulated water tank that is connected via at least one pipe to a heat exchanger, wherein the heat exchanger comprises a heat absorbing radiator of a heat pump to absorb heat from a water flow passing through the heat exchanger from the at least one pipe, a first water pump connected to the heat exchanger for delivering water from the insulated water tank to the heat exchanger via the at least one pipe and/or returning the water from the heat exchanger to the insulated water tank via the at least one pipe and/or at least one other pipe and the second inlet of the insulated water tank, at least one temperature detector for detecting the temperature of water in the insulated water tank, and a second outlet attached to the insulated water tank for dispensing the water in the insulated water tank to the user.

In one or more embodiments, the water mixing system further comprises a valve attached to the second inlet of the insulated water tank for altering a flow of the water returning from the heat exchanger to the insulated water tank.

In one or more embodiments, the water mixing system further comprises a cooled water tank connected via at least one pipe to a path of a water flow from the heat exchanger to the insulated water tank, wherein the cooled water tank collects all or a portion of the water flow from the heat exchanger.

In one or more embodiments, the water mixing system further comprises a cooled water tank connected via at least one pipe to a path of a water flow from the heat exchanger to the insulated water tank, wherein the cooled water tank collects all or a portion of the water flow from the heat exchanger, at least one pipe for connecting the cooled water tank to a path of a water flow from the insulated water tank to the heat exchanger and a second water pump for delivering water from the cooled water tank to the heat exchanger via the at least one pipe connecting the cooled water tank to the path of the water flow from the insulated water tank to the heat exchanger.

In one or more embodiments, the water mixing system further comprises a cooled water tank connected via at least one pipe to a path of a water flow from the heat exchanger to the insulated water tank, wherein the cooled water tank collects all or a portion of the water flow from the heat exchanger, a third water pump for delivering water from the cooled water tank to the insulated water tank via the at least one pipe connecting the cooled water tank to the path of the water flow from the heat exchanger to the insulated water tank and the second inlet of the insulated water tank.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
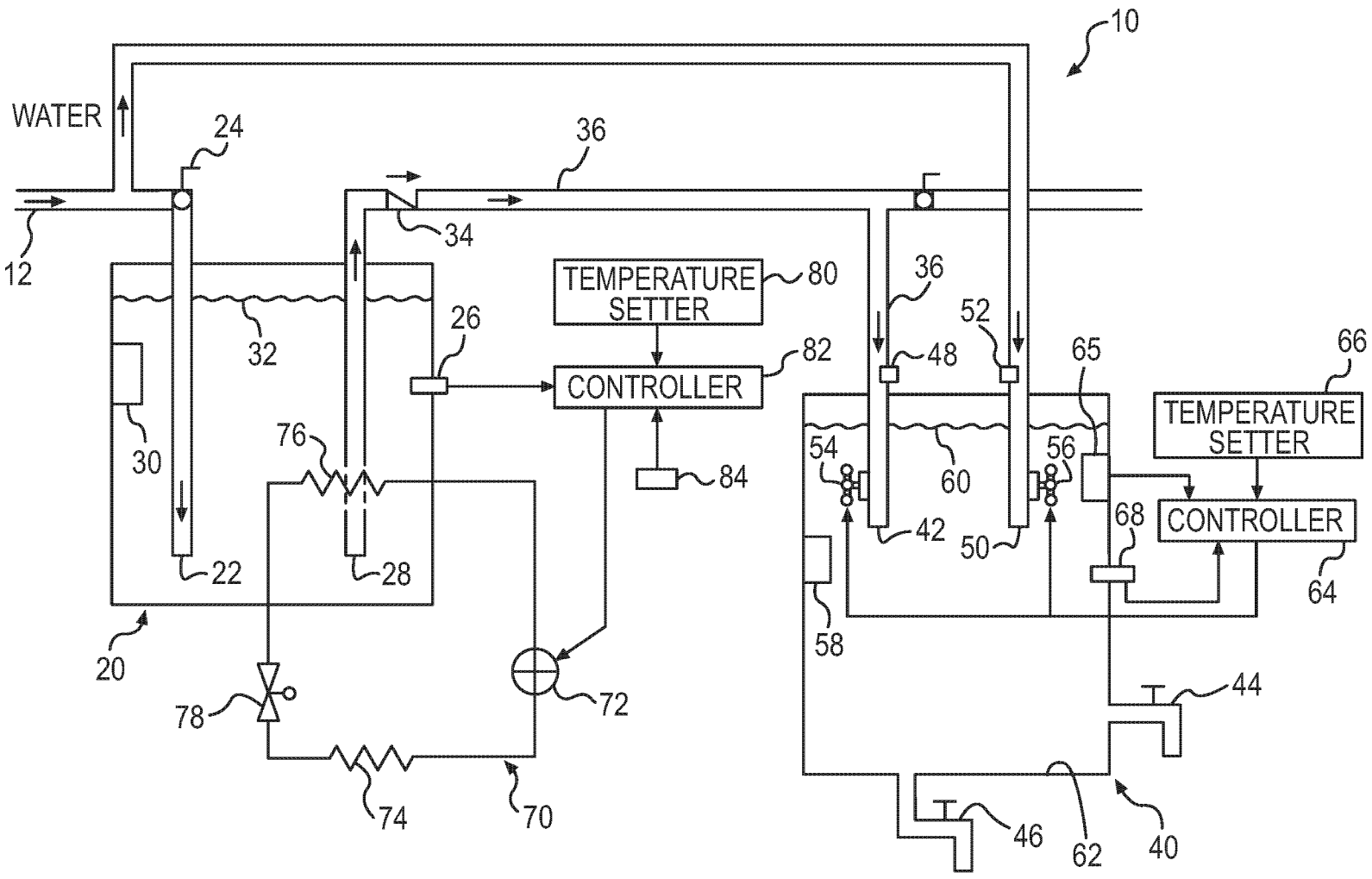
FIG. 1 is a schematic diagram of a water mixing system in accordance with a first exemplary embodiment of the present disclosure.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

Exemplary Embodiment 1

Referring to FIG. 1, an embodiment of the water mixing system according to a first aspect of the disclosure is designated generally 10 and includes an insulated water tank 20 having a first inlet 22 for ambient temperature water, a valve 24, such as a gate valve, a ball valve, or a solenoid valve, attached to the first inlet 22 of the insulated water tank 20 for altering a water flow therefrom, a first heat pump 70 connected to the insulated water tank 20, a first temperature detector 26 for detecting the temperature of water in the insulated water tank 20, a first outlet 28 attached to the insulated water tank 20 that is connected to a first dispensing water tank 40 via a first inlet 42, and a plurality of outlets (44 and 46) attached to the first dispensing water tank 40.

In one embodiment, the insulated water tank 20 is used to heat water of a low ambient temperature, e.g. municipal water from an existing plumbing system 12 during winter time or cool groundwater from an existing plumbing system, to make heated (hot) water. The low ambient temperature (cold) water enters the insulated water tank 20 through the first inlet 22, with the water flow controlled by the valve 24 that is operated either manually or automatically. The insulated water tank 20 is preferably vertically oriented, with the first inlet 22 for the low ambient temperature water located at a lower section of the insulated water tank, because water at a lower temperature has a higher specific gravity. The insulated water tank 20 preferably has an indicator for a water level 32 and has a control device, such as a float 30, which helps determine the quantity of water within the insulated water tank 20 by ascertaining the water level 32 and automatically stops the flow of the low ambient temperature water into the insulated water tank 20 when the water tank has filled to a predetermined level or to capacity. The insulated water tank 20 may be the water tank of a household water heater connected to the first heat pump 70, or a standalone insulated water tank capable of being configured to be connected to the first heat pump 70. The insulated water tank 20 may be covered with known insulation materials, such as fiberglass and polyurethane foam. In some embodiments, the low ambient temperature or cold water from the existing plumbing system 12 may have a temperature range of 4-30° C., or 8-25° C., or 10-15° C., and the heated or hot water from the insulated water tank 20 may have a temperature range of 35-100° C., or 40-95° C., or 45-90° C., or 50-80° C., or 55-70° C.

The term "heat pump" as used herein refers to a machine or device that moves heat from one location to another location. More specifically, the majority of heat pump technology involves movement of heat from a low temperature heat source to a higher temperature heat sink. For example, common heat pumps include but are not limited to food refrigerators and freezers, air conditioners and reversible-cycle heat pumps for providing domestic heating.

The heat pump transfers heat from one medium (e.g., an air source) to another medium (e.g., stored water in the insulated water tank). This is an advantageous way to heat water because it is generally more efficient to transfer heat than it is to create heat. This transfer of heat can be accomplished by the use of the thermodynamic principles of the vapor compression refrigeration cycle.

In one embodiment, the first heat pump 70 is an electric heat pump illustrated in FIG. 1 and including a compressor 72 that moves a heated refrigerant from a heat absorbing radiator 74 positioned outside the insulated water tank 20 to at least one heat rejecting radiator, one of which is a first heat rejecting radiator 76 positioned within the insulated water tank 20 where the refrigerant condenses at high pressure and releases the heat it absorbed earlier to the water in the insulated water tank 20. The refrigerant then moves to the heat absorbing radiator 74 via a decompressor 78 where the refrigerant is evaporated at low pressure and absorbs heat from the surrounding air. As shown in FIG. 1, the heat absorbing radiator 74, the first heat rejecting radiator 76, the compressor 72, and the decompressor 78 are joined by the interconnecting refrigerant-containing lines to form a closed circuit.

In another embodiment, the first heat pump 70 is a gas absorption heat pump, such as one available from Robur (Evansville, Ind., USA) that uses natural gas and a smaller amount of electricity as compared to an electric heat pump. In contrast to an electric heat pump, a gas absorption heat pump has an absorber and a generator in place of a compressor. In the absorber of the gas absorption heat pump, a gaseous refrigerant is absorbed by an absorbing fluid to form a liquid refrigerant solution. In the generator of the gas absorption heat pump, the liquid refrigerant solution and absorbing fluid is heated by means of a gas burner, separating the refrigerant, which evaporates, increasing in temperature and pressure. In a heat rejecting radiator of the gas absorption heat pump, the refrigerant flowing from the generator passes from a gaseous to liquid state, giving off heat to an external fluid (water or air). The refrigerant then passes through a series of restrictors of the gas absorption heat pump, equivalent to a decompressor in an electric heat pump, and is partially transformed into vapor and cooled, followed by entering a heat absorbing radiator of the gas absorption heat pump where the refrigerant absorbs heat from another external fluid (water or air) and evaporates completely, returning to a gaseous state. The gaseous refrigerant goes into the absorber of the gas absorption heat pump again, starting another cycle.

In one embodiment, the compressor 72 is a single speed compressor. In a preferred embodiment, the compressor 72 is a variable speed compressor for higher energy efficiency, for example, a variable speed compressor for an XV20i variable speed heat pump manufactured by Trane (Swords, County Dublin, Ireland). In some embodiments, the variable speed compressor is capable of slowing down or speeding up gradually in ½, ⅓, preferably ⅕, more preferably ⅛, or more preferably 1/10 of 1% increments.

In some embodiments, the heat absorbing radiator 74 positioned outside the insulated water tank 20 absorbs heat from air, commonly ambient air, or water, for example, from the water table, preferably at a limited depth below the surface, rivers, and lakes, preferably in proximity to the insulated water tank 20, and from water heated by solar radiation, or ground into which specific pipes containing the heat absorbing radiator 74 are sunk to varying depths (these pipes constitute a geothermal system).

Figure 2:
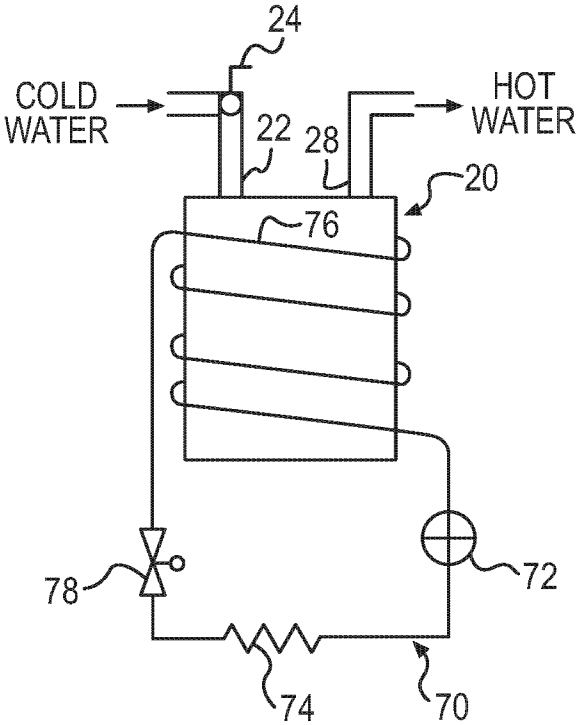
FIG. 2 is a schematic diagram showing a heat rejecting radiator of a heat pump closely disposed to the outer wall of an insulated water tank in accordance with a first exemplary embodiment of the water mixing system of the present disclosure.

In another embodiment, the first heat rejecting radiator 76 of the first heat pump 70 can be closely disposed to the outer wall of the insulated water tank 20 such that it surrounds the insulated water tank 20 or wraps around the insulated water tank 20 as shown in FIG. 2.

Water heated and stored in the insulated water tank 20, if it is not agitated, may thermally stratify in thermoclines, where warmer layers of water meet cooler layers. When the stratification occurs, water supplied by the tank may not be of a homogeneous temperature. In some embodiments, the insulated water tank 20 may comprise means to obviate thermal stratification of the water by sufficient vertical agitation of the water in the insulated water tank 20. There is a number of ways for agitating water to de-stratify the water in the insulated water tank 20. For example, a mechanical mixer comprising a screw or blade turned by a motor may be installed inside the insulated water tank 20 to agitate water in the tank. One such mechanical mixer, e.g. PMW100, may be obtained from PAX Water (Richmond, Calif., USA). Additionally, the water in the insulated water tank 20 may be agitated and de-stratified by pressurized gas, preferably air, which forms large agitating or mixing bubbles to generate currents in the water, as disclosed by U.S. Pat. No. 8,147,117 B2, incorporated herein by reference in its entirety. One such pressurized gas-based agitator or mixer may be obtained from Pulsair (Bellevue, Wash., USA).

The water heated and stored in the insulated water tank 20 may have undesirably high levels of sodium and/or other minerals, particularly hardness ions. In other embodiments, the insulated water tank 20 may comprise means for removing sodium and/or other minerals, particularly calcium and magnesium hardness ions, from the water heated and stored in the insulated water tank 20. For example, one or more fixed bed columns or cartridges comprising at least one ion exchange resin and/or other filter media and connected in series or in parallel may be attached to the first outlet 28 of the insulated water tank 20 to soften the water and/or remove sodium from the water before the water is supplied to the first dispensing water tank 40. Alternatively, the insulated water tank 20 may be configured such that the water in the insulated water tank 20 passes through one or more fixed bed columns or cartridges comprising at least one ion exchange resin and/or other filter media and connected in series or in parallel from an upper level of the insulated water tank 20, with the water having reduced concentrations of sodium and other minerals exiting the fixed bed columns or cartridges at a lower level of the insulated water tank 20. Further alternatively, the ion exchange resins and/or other filter media to remove sodium and/or other minerals from the water may be encapsulated in one or more water permeable polymer fabric bags, which are then placed in the insulated water tank 20, preferably at locations where the tank water circulates, e.g. adjacent the first inlet 22, adjacent the first outlet 28, and/or where the water currents occur if there is a water agitation caused by a mechanical mixer or pressurized gas agitator or mixer described above. Preferably, each of the water permeable polymer fabric bags is filled with a quantity of resin or filter medium to accommodate swelling and to provide floating of the resin within the bag so as to create a fluidized bed therein. The material of the water permeable polymer fabric bags may be polypropylene, polyester, cotton, rayon, polyethylene, nylon, PTFE (Teflon), polyacrylonitrile, or acrylic, with a porosity range of 5-1000 microns, or 10-900 microns, or 50-800 microns, or 100-700 microns, or 200-500 microns. The fabric types may be woven, nonwoven, felt, or mesh of thickness of, for example, 0.01"-0.25". The types of the ion exchange resins and a preferred combination of a "standard mesh" type of resin beads and a "fine mesh" type of resin beads to remove minerals from water are disclosed in European Patent No. EP0225793 B1 and U.S. Pat. No. 5,464,532 A, each incorporated herein by reference in its entirety. The filter medium compositions for removing sodium in drinking water is disclosed in Chinese Patent No. CN102059022 B, incorporated herein by reference in its entirety.

In some embodiments, to help stabilize the temperature of water inside the insulated water tank 20, the insulated water tank 20 may comprise one or more thermally conductive bodies, each of which encloses a cavity filled with thermal ballast as temporary buffer for the thermal energy and is in contact with the water inside the tank. The thermally conductive bodies may be in the forms of pipes, blocks, and walls disposed within and/or lining the inside wall of the insulated water tank 20 in contact with the tank water. The cavity of the conductive body containing the thermal ballast may be sealed, or may have a sealable opening, such as a removable cap or plug, for changing the type of thermal ballast to help stabilize different desired temperatures of water inside the insulated water tank 20 or replacing thermal ballast.

In some embodiments, the thermal ballast is selected from a set consisting of materials that undergo a phase change, such as from solid to liquid, at a temperature near a desired temperature of the water in the insulated water tank 20. Non-limiting examples of suitable phase-change materials include organic paraffin, organic non-paraffin and inorganic salt hydrate.

A sensible material may also be used as thermal ballast. A sensible material is one which remains within the same phase, typically solid or liquid, across all desired temperatures of the water inside the insulated water tank 20. If a sensible material is used for the thermal ballast, then the sensible material is preferably selected from materials having a high specific heat capacity, such as in excess of 2500 joules/° K kg, preferably in excess of 4170 joules/° K kg, or more preferably in excess of 5500 joules/° K kg. Non-limiting examples of suitable sensible materials include water and saline.

In a preferred embodiment, the thermal ballast is a non-toxic material capable of storing relatively large amounts of heat without experiencing significant changes in temperature while the water inside the insulated water tank 20 is at or near a desired temperature. To provide for maximum heat-storage capabilities within the cavity, as much thermal ballast as possible should be disposed within the cavity, while providing sufficient space to accommodate for thermal expansion and other factors.

The insulated water tank 20 has the first temperature detector 26 for detecting a temperature of water inside the insulated water tank 20. Optionally, a user can set a target temperature to meet the user's need with a temperature setter 80 for the insulated water tank 20 connected to a controller 82 that controls the rotation speed of the compressor 72 of the first (electric) heat pump 70 based on the temperature of the water in the insulated water tank 20, the target temperature, and the ambient air temperature detected by an air temperature detector 84 using, for example, the proportional integration-differentiation control, which is known to the public, based on the deviation between the target temperature and the actual water temperature. The controller 82 stores in advance a relation between a heating amount in the first heat rejecting radiator 76 and a rotation speed of the compressor 72 at every air temperature.

To transfer the same amount of heat from the ambient air to the water in the insulated water tank 20 at the same air temperature, the first heat pump 70 is more energy efficient when the compressor 72 is running at a slower speed for a longer time than when the compressor 72 is running at a higher speed for a short time. Thus, alternatively, the controller 82 may control the rotation speed of the compressor 72 based on the temperature difference between the target temperature and the actual temperature of the water in the insulated water tank 20 in a simplified and preferably an energy efficient way. In one embodiment, the rotation speed of the compressor 72 is set at X percent of the maximum rotation speed, wherein X is equal to the difference between the target temperature (in Celsius) and the actual temperature (in Celsius) of the water in the insulated water tank 20. For example, when the actual temperature of the water in the insulated water tank is 20° C., and the target temperature is 50° C., with the temperature difference being 30° C., the controller 82 will set the rotation speed of the compressor 72 at 30% of the maximum speed. To further increase the energy efficiency of the first heat pump 70, in some embodiments, X (in percentage of the maximum rotation speed of the compressor 72) may be numerically a fraction of the difference between the target temperature (in Celsius) and the actual temperature (in Celsius) of the water in the insulated water tank 20, particularly when the maximum rotation speed of the compressor 72 is large, e.g. greater than 2500 rpm, or greater than 3000 rpm, or greater than 3500 rpm, when the first heat pump 70 is a high power heat pump, and/or when the temperature difference is small, e.g. no greater than 10° C., or no greater than 5° C., and there is a good possibility of overshoot. For example, when the actual temperature of the water in the insulated water tank 20 is 40° C., and the target temperature is 50° C., with the temperature difference being 10° C., the controller 82 may set the rotation speed of the compressor 72 at 1% (i.e. 1/10 of the temperature difference×100%), or 2% (i.e. 1/5 of the temperature difference×100%), or 5% (i.e. 1/2 of the temperature difference×100%), or 7.5% (i.e. 3/4 of the temperature difference×100%) of the maximum rotation speed of the compressor 72. Additionally, the controller 82 may have a slow ramp-up feature to gradually increase the rotation speed of the compressor 72 to the set speed to minimize strain on the first heat pump 70, particularly on the electronics and particularly during start-up. In some embodiments, the rotation speed of the compressor 72 is increased at a rate of 0.1-20%, preferably 0.1-10%, more preferably 0.1-5%, more preferably 0.1-2% of the set rotation speed per minute. Of course, the first heat pump 70 may be operated manually, being turned on when the water temperature in the insulated water tank 20 is lower than the target temperature and turned off when the target temperature of the water is reached.

Although the insulated water tank 20 is covered with heat insulator, the water temperature lowers gradually due to heat dissipation. In one embodiment, the controller 82 detects a decrease in the water temperature inside the insulated water tank 20 with the first water temperature detector 26. When the water temperature inside the insulated water tank 20 decreases to a temperature lower than a lower limit, the controller 82 drives the compressor 72 at a certain rotation speed set in a manner described above, activating the first heat rejecting radiator 76 of the first heat pump 70 to raise the water temperature inside the insulated water tank 20. When the water temperature inside the insulated water tank 20 reaches or exceeds a target temperature, the controller 82 stops driving the compressor 72.

The water heated by the first heat rejecting radiator 76 of the first heat pump 70 exits the insulated water tank 20 through the first outlet 28, preferably located at a lower section of the insulated water tank 20 to access the entire or almost the entire volume of the water in the insulated water tank 20, and flows into the first dispensing tank 40 via a connecting pipe 36 attached to the first inlet 42 of the dispensing tank 40, which is called the hot water inlet of the first dispensing tank 40 hereafter. In one embodiment, the first outlet 28 of the insulated water tank 20 is preferably controlled by a valve 34, more preferably a restriction valve or a check valve to restrict or block a back flow of the heated water to the insulated water tank 20, and preferably it is open only when the heated water in the insulated water tank 20 reaches a target temperature. The connecting pipe 36 adjacent the hot water inlet 42 of the first dispensing water tank 40 may be optionally equipped with another water temperature detector 48 for detecting a temperature of the heated water supplied to the first dispensing water tank 40, particularly when there is a significant heat loss of the heated water transiting through the connecting pipe 36. When there is a significant temperature difference between the heated water exiting the insulated water tank 20 and the heated water flowing into the first dispensing water tank 40 via the hot water inlet 42, the target temperature of the heated water in the insulated water tank 20 may be set higher than the desired temperature of the heated water entering the first dispensing water tank 40. The volume ratio of the insulated water tank 20 to the first dispensing water tank 40 may vary, depending on the usage of the heated water from the insulated water tank 20, the usage of the mixed water in the first dispensing water tank 40, the temperature difference among the heated water in the insulated water tank 20, the ambient temperature water, and the target temperature of the water in the first dispensing water tank 40. It is contemplated that no greater than an equal volume of the heated water from the insulated water tank 20 is preferably mixed with the ambient temperature water in the first dispensing water tank 40 to obtain the mixed water of a desirable temperature. Thus, in a preferred embodiment, the volume ratio of the insulated water tank 20 to the first dispensing water tank 40 is no greater than 1:1, or no greater than 1:2, or no greater than 1:3.

The first dispensing water tank 40 is also attached to the existing plumbing system 12, receiving the low ambient temperature water via a second inlet 50, which is called the cold water inlet of the first dispensing water tank hereafter. The cold water inlet 50 may be equipped with a water temperature detector 52 for detecting a temperature of the low ambient temperature water entering the first dispensing water tank 40. The first dispensing water tank 40 has at least one water outlet, such as the outlets 44 and 46. The size of the first dispensing water tank 40 may be varied, to serve the differing usage goals. In one embodiment, the hot and cold water inlets (i.e. the first and second inlets of the first dispensing water tank 40) 42 and 50 are each selectively controllable with a pair of valves, for example, solenoid valves 54 and 56. The solenoid valves 54 and 56 are each capable of selectively stopping all flow through their respective inlets; allowing a maximum flow through their respective inlets; or allowing flow at any level of flow less than the maximum flow. The first dispensing water tank 40 has a float 58 within the tank interior. The float 58 helps determine the quantity of water within the first dispensing water tank 40 by ascertaining the water level 60. Water leaves the first dispensing water tank 40 through one of the water outlets 44 and 46. The water outlet is preferably as close to the tank bottom as possible, so that all water can be drained from the first dispensing water tank 40.

In an alternate embodiment, one of the water outlets 44 may be located somewhat above the first dispensing water tank bottom 62, for example, on a side of the first dispensing water tank 40. An additional water outlet 46 may be provided along the first dispensing water tank bottom 62. Normally, water will drain from the first dispending water tank 40 until the water level 60 reaches the side water outlet 44. Thus, a small reserve supply will remain in the first dispensing water tank 40. In the event of an emergency, the additional water outlet 46 will allow the reserve supply at the first dispensing water tank bottom 62 to be retrieved.

The first dispensing water tank 40 may be equipped with a controller 64 receiving inputs from a temperature setter 66, a second temperature detector 68 for detecting a temperature of the water within the first dispensing water tank 40, the float 58, and a water level indicator 65, and controlling the solenoid valves 54 and 56 regulating the heated and low ambient temperature water flows into the first dispensing water tank 40 based on the inputs. The temperature setter 66 may be any electrical, mechanical, or electromechanical means by which the user may set the desired temperature for the water. The second temperature detector 68 provides visual and/or audible indication of the actual temperature of the water within the first dispensing water tank 40. The water level indicator 65 helps the user monitor the water level 60 within the first dispensing water tank 40. The water level indicator 65 generally works in conjunction with the float 58 for determining and displaying the water level. The first dispensing water tank 40 may be set at different modes of operation, including the filling mode, the dispensing mode, the off mode, and the reserve mode.

While in the filling mode, the solenoid valves 54 and 56 regulating the heated water supply and low ambient temperature water supply are opened, while the water outlets 44 and 46 are closed, allowing the first dispensing water tank 40 to begin filling. The solenoid valves 54 and 56 selectively and separately control the heated water supply and low ambient temperature water supply, according to the desired water temperature, and according to the actual water temperature inside the first dispensing water tank 40. The solenoid valves 54 and 56 will adjust many times until an equilibrium situation is present, wherein the actual water temperature is substantially the same as the desired water temperature. Such repetitive adjustment is well known and needs not be discussed in detail, because the same is the subject of numerous texts on control systems, such as CONTROL SYSTEMS by CHT-TSONG CHEN, SPAULDING PUBLICATIONS. While in the filling mode, the user can observe the water level rising by watching the water level indicator 65. Many users will prefer to allow the water level to rise until a level is reached. If the float 58 detects that the first dispensing water tank 40 has filled to a preset level or to capacity, it automatically stops water flow through the hot water inlet 42 and cold water inlet 50.

Once the first dispensing water tank 40 is filled with the mixed water of a desired temperature, the user may select the dispensing mode. Once the dispensing mode is selected, water of a desired temperature is allowed to flow from the first dispensing water tank 40, through the side outlet 44. While in the dispensing mode, the water is gradually depleted from the first dispensing water tank 40, as the solenoid valves 54 and 56 cut off water from entering the first dispensing tank 40 through the hot water inlet 42 and cold water inlet 50. Once the water is fully depleted from the first dispensing water tank 40, the first dispensing water tank 40 may be switched back to the filling mode.

While in the off mode, water does not enter the first dispensing water tank 40 through the hot water inlet 42 and the cold water inlet 50. Further, no water exits the first dispensing water tank through the outlet 44 or 46.

The reserve mode works when the first dispensing water tank 40 described herein is configured according to the alternate embodiment discussed above wherein one of the water outlets 44 is positioned above the first dispensing water tank bottom 62, for example, on a side of the first dispensing water tank 40, and an alternate water outlet 46 is positioned at the first dispensing water tank bottom 62. With this configuration, once the first dispensing water tank 40 has been partially or fully filled, and then has been depleted through the side outlet 44 in the dispensing mode, reserve water will be stored below the side outlet 44. This water may be retrieved in the event of an emergency by entering the reserve mode. Once the reserve mode has been entered, water is allowed to flow from the alternate water outlet 46 at the first dispensing water tank bottom 62, releasing the reserve supply to the user.

In a simplified embodiment of the first dispensing water tank 40, the valves regulating the hot water inlet 42 and cold water inlet 50 may be controlled manually without the desired temperature setting control. For example, in the filling mode, the user may manually control the volumes of the heated water and low ambient temperature water entering the tank by monitoring the second temperature detector 68 and the water level indicator 65 as the first dispensing water tank 40 fills, and adjust the valves until the desired temperature and desired water level are achieved. The user can then deplete the first dispensing water tank 40 by placing the first dispensing water tank 40 in the dispensing mode.

Figure 3:
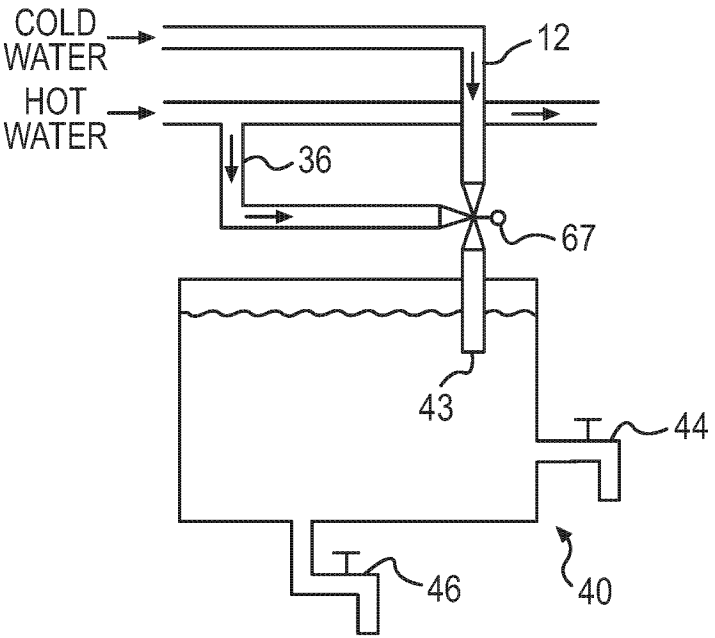
FIG. 3 is a schematic diagram showing a mixing valve 67 connected to the first outlet 28 attached to the insulated water tank 20, the existing plumbing system 12 and an inlet 43 of a first dispensing water tank 40 in accordance with a first exemplary embodiment of the water mixing system of the present disclosure.

Alternatively, referring to FIG. 3, the heated (hot) water flowing from the first outlet 28 of the insulated water tank 20, the low ambient temperature (cold) water from the existing plumbing system 12 may be fed into a mixer via their respective connecting pipes. The mixer may be a converging member or a mixing valve 67 that has a pre-set mixing ratio of the heated (hot) water to the low ambient temperature (cold) water. Also connected to an inlet 43 of the first dispensing water tank 40, the mixer supplies the mixed water, preferably at a desirable temperature, to the first dispensing water tank 40. This is an advantageous embodiment when the actual temperatures of the heated water and the low ambient temperature water entering the mixer are known and the mixing ratio can be easily calculated based on a desired temperature of the mixed water. For example, if the temperature of the low ambient temperature (cold) water is 15° C. and the temperature of the heated (hot) water is 50° C., mixing equal volumes of the low ambient temperature water and the heated water will result in mixed water with a calculated temperature of 32.5° C.

In some embodiments, the first dispensing water tank 40 has the same or equivalent means for agitating tank water to maintain a homogeneous water temperature, for removing hardness ions and/or sodium from the tank water, and for stabilizing the tank water temperature with thermal ballast as those described for the first insulated water tank 20.

Exemplary Embodiment 2

Figure 4:
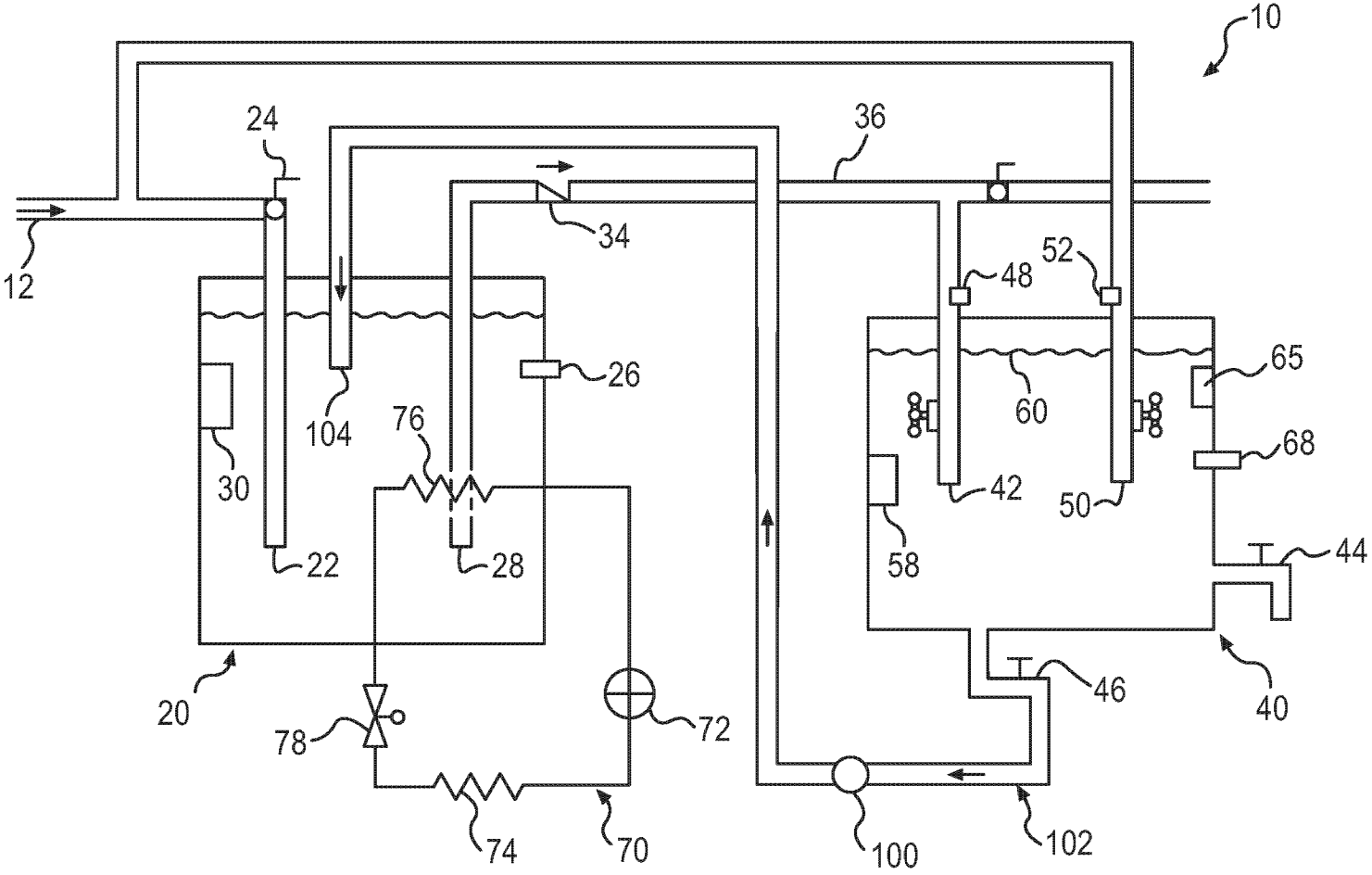
FIG. 4 is a schematic diagram of a water mixing system in accordance with a second and a third exemplary embodiment of the present disclosure.

To inhibit heat loss due to heat exchange between the first dispensing water tank 40 and its environment, the first dispensing water tank 40 is preferably covered with heat insulator. In case the water temperature in the first dispensing water tank 40 falls below a lower limit of the desired temperature, in one embodiment, the first dispensing water tank 40 may have an additional reheat mode, operated either manually or automatically with a controller comprising a set point thermostat, for example, wherein an outlet of the first dispensing water tank 40, preferably one located at the bottom of the first dispensing water tank capable of draining all the water in the first dispensing water tank 40, e.g. the outlet 46, is further connected to a first water pump 100 via a connecting pipe 102 as shown in FIG. 4. The first water pump 100 then returns all or a portion of the water from the first dispensing water tank 40 to the insulated water tank 20, preferably via a second inlet 104 located at an upper section of the insulated water tank 20, to be mixed with the heated water already in the insulated water tank 20 and reheated.

In one embodiment, the first water pump 100 is stopped when all the water is transferred from the first dispensing water tank 40 back to the insulated water tank 20 to be reheated. The first dispensing water tank 40 may then be refilled in the filling mode to obtain mixed water of a desirable temperature.

In another embodiment, the first water pump 100 may operate to transfer a portion of the water from the first dispensing water tank 40 to the insulated water tank 20 to be reheated, while the hot water inlet 42 of the first dispensing water tank 40 is open to receive the heated water from the insulated water tank 20 until the water in the first dispensing water tank 40 reaches a target temperature.

Exemplary Embodiment 3

Figure 5:
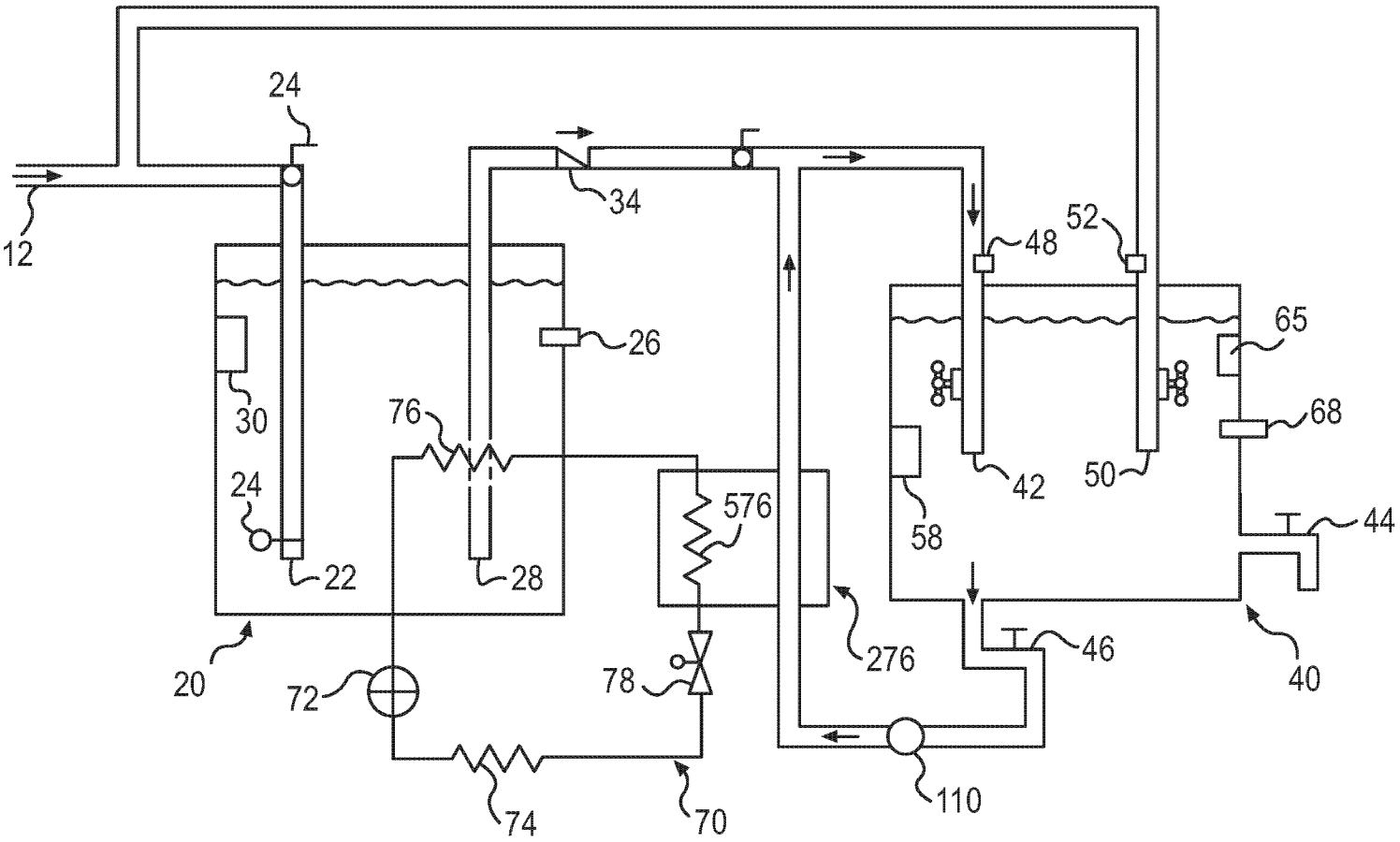
FIG. 5 is a schematic diagram of a water mixing system in accordance with a third exemplary embodiment of the present disclosure.

In still another embodiment of the reheat mode, a second water pump 110 may deliver all or a portion of the water from the first dispensing tank 40 to a heat exchanger 276 comprising a second heat rejecting radiator 576 of the first heat pump 70 connected to the insulated water tank 20, as shown in FIG. 5, with the reheated water returned to the first dispensing water tank 40 via the hot water inlet 42 or a separate inlet. This is an advantageous embodiment, because when the first heat pump 70 is in use to heat the water in the insulated water tank 20, the heat exchanger 276 is already warmed up and capable of reheating the water from the first dispensing water tank 40 without a wait time. The second water pump 110 and/or the heat exchanger 276 may be controlled manually or automatically with a controller comprising a set point thermostat, for example, based on the reading of the second temperature detector 68 in the first dispensing water tank 40, such that the second water pump 110 and/or the heat exchanger 276 are in operation to drive the water from the first dispensing water tank 40 through the heat exchanger 276 to be reheated and back to the first dispensing water tank 40 continuously until a desired water temperature in the first dispensing water tank 40 is reached. Of course the second water pump 110 may deliver all or a portion of the water from the first dispensing tank 40 to a heat exchanger comprising a heat rejecting radiator of another heat pump to be reheated. In still another embodiment, the heat exchanger reheating the water from the first dispensing water tank may be disposed inside the first dispensing water tank or disposed on the outer wall of the first dispensing water tank such that it surrounds the first dispensing water tank 40, without a need to circulate the tank water outside the first dispensing water tank 40 via the outlet 46 and the second water pump 110.

Referring to FIG. 4, in still another embodiment, the first dispensing water tank 40 may have a sanitation mode, wherein the cold water inlet 50 is closed and the hot water inlet 42 is open. An outlet of the first dispensing water tank 40, preferably one located at the bottom of the first dispensing water tank capable of draining all the water in the first dispensing water tank 40, e.g. the outlet 46, is connected to the first water pump 100 via the connecting pipe 102. The first water pump 100 drives the hot water from the first dispensing water tank 40 to the insulated water tank 20, preferably via the second inlet 104 located at an upper section of the insulated water tank 20, to be mixed with the water in the insulated water tank 20, and the heated water flows out of the insulated water tank 20 via the first outlet 28 and supplies to the first dispensing water tank 40 via the hot water inlet 42. The first water pump 100 may be in operation continuously in the sanitation mode, or the first water pump 100 may be regulated such that it is in operation only when the first dispensing water tank 40 is filled to capacity with the heated water from the insulated water tank 20 to actuate the opening of the outlet 46 connected to the first water pump 100. In the sanitation mode, the flow of the heated water from the insulated water tank 20 may be continuous, or may be regulated such that only when the heated water in the insulated water tank 20 reaches a pre-determined temperature range does the heated water starts to fill the first dispensing water tank 40 via the hot water inlet 42. The circulation of the heated water between the insulated water tank 20 and the first dispensing water tank 40 cleans the interior of the first dispensing water tank 40, the first water pump 100, and the connecting pipes.

Besides being capable of heating the low ambient temperature water in the insulated water tank 20 and mixing the resulting heated water with the low ambient temperature water at a desired ratio to obtain the mixed water of a desired (moderate or intermediary) temperature in the first dispensing water tank 40, the above mentioned water mixing system may be configured to cool (high) ambient temperature water, e.g. water having a temperature of 35-80° C., 40-70° C., or 50-60° C., in the insulated water tank 20 and mix the resulting cooled water, e.g. water having a temperature of 4-65° C., 10-50° C., 20-40° C., or 25-35° C., with the (high) ambient temperature water at a desired ratio to obtain the mixed water of a desired (moderate or intermediary) temperature in the first dispensing water tank 40, by cooling the (high) ambient temperature water in the insulated water tank 20 with the heat absorbing radiator 74 of the first heat pump 70.

Exemplary Embodiment 4

Figure 6:
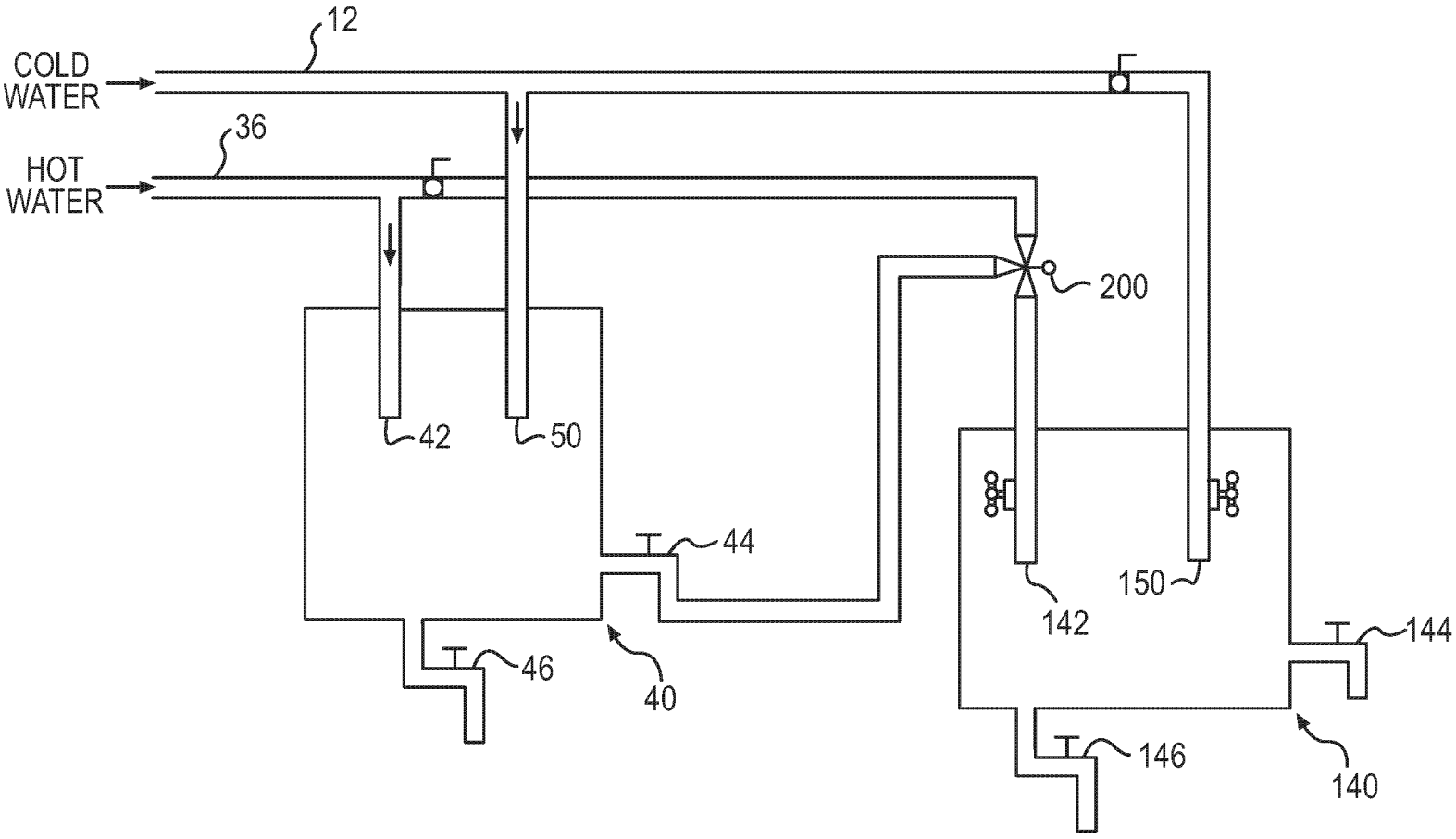
FIG. 6 is a schematic diagram of a water mixing system in accordance with a fourth exemplary embodiment of the present disclosure.

Referring to FIG. 6, in another embodiment, the above mentioned water mixing system further comprises a second dispensing water tank 140 connected in series with the first dispensing water tank 40, i.e. one of the outlets, preferably a non-reserve outlet, e.g. the side outlet 44, of the first dispensing water tank 40, is connected to a first inlet 142 of the second dispensing water tank 140. Additionally, the second dispensing water tank 140 is attached to the existing plumbing system 12 via a second inlet 150 receiving the low ambient temperature (cold) water. In some embodiments, the second dispensing water tank 140 has the same features and various embodiments as the first dispensing water tank 40. In other embodiments, the second dispensing water tank 140 has the same or equivalent means for agitating tank water to maintain a homogeneous water temperature, for removing hardness ions and/or sodium from the tank water, and for stabilizing the tank water temperature with thermal ballast as those described for the first insulated water tank 20.

Downstream of the first dispensing water tank 40, the second dispensing water tank 140 usually contains the mixed water of water from the first dispensing water tank 40 having a lower temperature than the heated (hot) water in the insulated water tank 20 and the low ambient temperature (cold) water from the existing plumbing system 12. As a result, the temperature of the mixed water in the second dispensing water tank 140 usually is lower than that of the mixed water in the first dispensing water tank 40. One advantage of having the additional one or more dispensing water tanks, such as the second dispensing water tank 140, downstream of the first dispensing water tank 40 is being able to prepare and store a smaller amount of water of a very high temperature that may exceed the maximum safe delivery temperature, e.g. 120° F. by the US Consumer Product Safety Council, in the insulated water tank 20 and/or the first dispensing water tank 40, and to provide a larger amount of the mixed water at a safe delivery or moderate temperature range in the second dispensing water tank 140. With the first dispensing water tank 40 connected to the second dispensing water tank 140, the second dispensing water tank 140 may serve as a backup mixed water tank of the first dispensing water tank 40. For example, when the first dispensing water tank 40 is not in service due to repair or cleaning, or when the mixed water in the first dispensing water tank 40 has to be stored, heated (hot) water from the insulated water tank 20 may bypass the first dispensing water tank 40 and supply directly to the second dispensing water tank 140 via a converging member or a mixing valve 200 and the first inlet 142. In the second dispensing water tank 140, the heated (hot) water from the insulated water tank 20 is mixed with the low ambient temperature (cold) water from the existing plumbing system 12 via the second inlet 150.

Exemplary Embodiment 5

Figure 7:
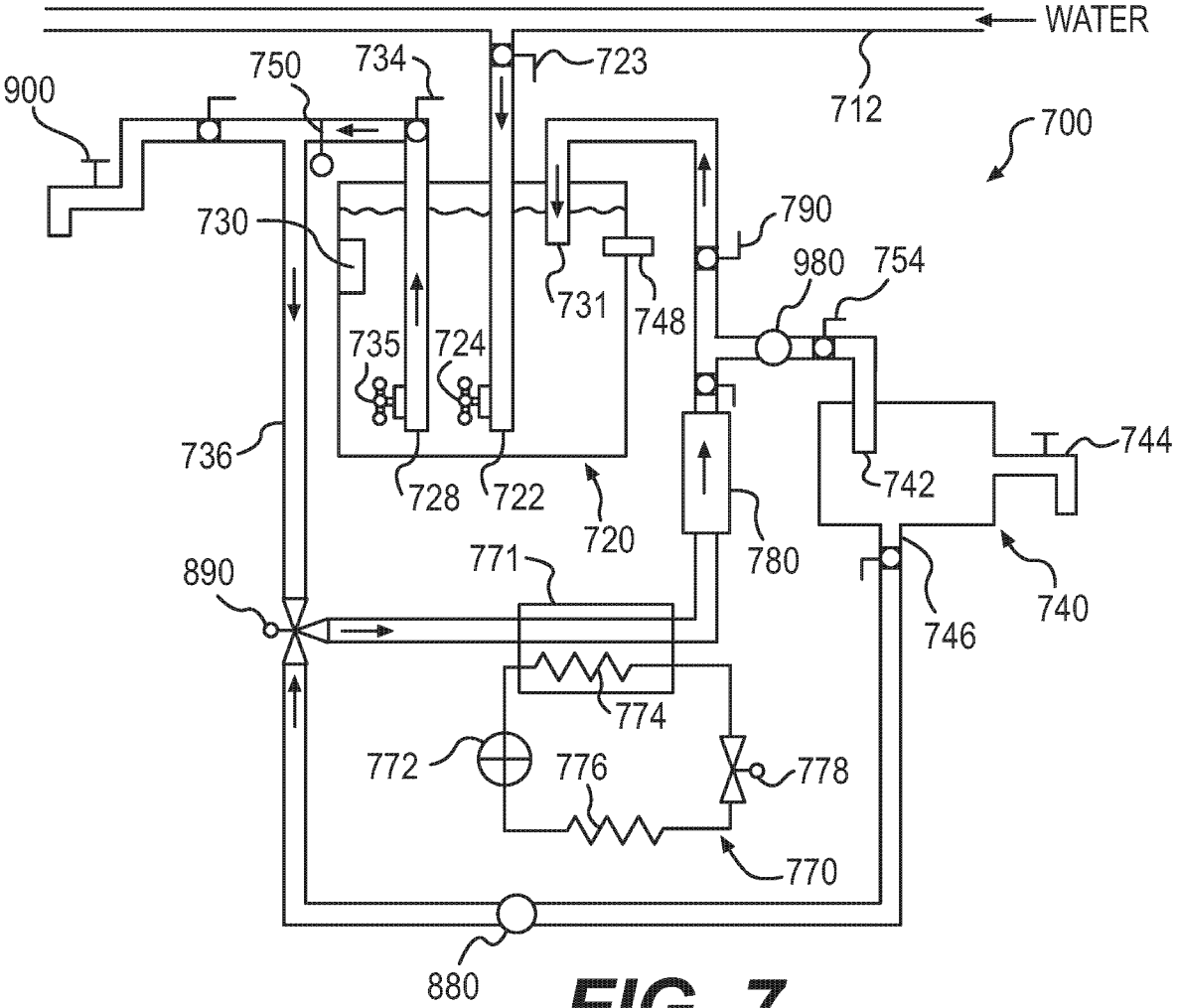
FIG. 7 is a schematic diagram of a water mixing system in accordance with a fifth exemplary embodiment of the present disclosure.

Referring to FIG. 7 for a water mixing system 700 according to a second aspect of the disclosure. The system includes an insulated water tank 720, which can be an insulated water storage tank or an insulated water tank in a household water heater with the heating function disabled, and which receives ambient temperature water, preferably of a high ambient temperature, for example, tap water or groundwater with a temperature range of 35-80° C., 40-70° C., or 50-60° C. in the summertime, from an existing plumbing system 712 via a first inlet 722, attached to which is a valve, which can be a manually controlled valve 723 (e.g. a ball valve) and/or a solenoid valve 724, to control or alter the ambient temperature water flow into the insulated water tank 720. The insulated water tank 720 may optionally be equipped with a water level indicator (not shown) and a float 730. The temperature of water in the insulated water tank 720 is detected by a temperature detector 748.

The insulated water tank 720 has a first outlet 728. A valve 734, such as a ball valve and gate valve, and/or a solenoid valve 735, may be attached to the first outlet 728 to control the flow of water out of the insulated water tank 720 into a heat exchanger 771 comprising a heat absorbing radiator 774 of a heat pump 770 to be cooled via a connecting pipe 736. The water flow rate may be monitored by a flow sensor 750.

As shown in FIG. 7, besides the heat absorbing radiator 774, the heat pump 770 includes a compressor 772, a heat rejecting radiator 776 exposed to ambient air, and a decompressor 778. In some embodiments, the heat pump 770 and its component parts have the same characteristics, features, and embodiments as the heat pump 70 and its component parts described in the first aspect of the present disclosure.

The insulated water tank 720 has a second outlet 900 for dispensing the water in the insulated water tank 720 to the user. As illustrated in FIG. 7, the second outlet 900 is connected to and branched from the first outlet 728. Alternatively, the second outlet 900 may be an outlet of the insulated water tank 720 separate from the first outlet 728.

In one embodiment illustrated in FIG. 7, the heat exchanger 771 comprises the heat absorbing radiator 774 of the heat pump 770, with a cold refrigerant in the heat absorbing radiator 774 passing through one side of the heat exchanger 771 and the water from the insulated water tank 720 passing through the other side of the heat exchanger 771. As a result, the refrigerant absorbs heat from the water. The cooled water exiting the heat exchanger 771 with a water temperature of, for example, 4-65° C., 10-50° C., 20-40° C., or 25-35° C. circulates back to the insulated water tank 720 by way a first water pump 780 and a valve 790. The valve 790 may be a manually controlled valve, such as a ball valve, or an electrical valve, preferably a solenoid valve attached to a second inlet 731 that controls the flow of the cooled water into the insulated water tank 720 through the second inlet 731. The water may circulate into and out of the insulated water tank 720 continuously until a desired water temperature detected by the temperature detector 748 is reached. A simple set point thermostat may be installed on the water mixing system 700 to automatically turn off the heat pump 770 and the first water pump 780 at a preset target temperature. Alternatively, the compressor 772 of the (electric) heat pump 770 is preferably a variable speed compressor, and the water mixing system 700 may further comprise a controller that controls the rotation speed of the compressor 772 of the heat pump 770 based on the temperature of the water inside the insulated water tank 720, the desired target water temperature, and/or the ambient air temperature the heat rejecting radiator 776 of the heat pump 770 is exposed to in a manner similar to that described for the controller 82 of FIG. 1 in the first aspect of the present disclosure.

In another embodiment, the water mixing system 700 may further comprise a cooled water tank 740 situated downstream of the heat exchanger 771 and in parallel to the insulated water tank 720 as a storage or dispensing tank. In this embodiment, a portion or all of the cooled water exiting the heat exchanger 771 may be gathered in the cooled water tank 740 via an inlet 742 controlled by a valve 754 and dispensed to a user via an outlet 744.

In still another embodiment, the cooled water in the cooled water tank 740 may be circulated back to the heat exchanger 771 via an outlet 746, a second water pump 880, and a valve 890, e.g. a three way control valve as shown in FIG. 7, and subsequently returned to the cooled water tank 740 via the inlet 742, to make the cooled water even colder, for example, with a water temperature of 4-50° C., 4-30° C., or 10-20° C. in the cooled water tank 740 for storage, dispensing, and/or optionally supplying to the insulated water tank 720 via a third water pump 980 and the second inlet 731 of the insulated water tank 720.

In some embodiments, the insulated water tank 720 and the cooled water tank 740 have the same or equivalent means for agitating tank water to maintain a homogeneous water temperature, for removing hardness ions and/or sodium from the tank water, and for stabilizing the tank water temperature with thermal ballast as those described for the first insulated water tank 20 in the first aspect of the present disclosure.

Having described the various structural and functional attributes of the illustrated embodiment of FIG. 7, the following describes the basic operation of the same.

When the insulated water tank 720 is empty, the water mixing system 700 is turned on in its filling mode, in which the valve 723 and/or 724 regulating the first inlet 722 of the insulated water tank 720 is open to allow the ambient temperature water from the existing plumbing system 712 to enter the insulated water tank 720 to fill. A user can monitor the water level and turn off the first inlet valve 723 and/or 724 manually when the insulated water tank 720 fills to a certain level or to capacity. If the insulated water tank 720 is equipped with the float 730, the first inlet valve 724 can be automatically turned off when the insulated water tank 720 fills to a certain level or to capacity. Then the water mixing system 700 is in its cooling mode, with the valve 734 and/or 735 regulating the first outlet 728 of the insulated water tank 720 turned open, allowing the water in the insulated water tank 720 to flow into the heat exchanger 771 comprising the heat absorbing radiator 774 of the heat pump 770 to be cooled. The cooled water circulates back to the insulated water tank 720 via the first water pump 780 and the valve 790. A controller, which may be a set point thermostat and/or a controller controlling the rotation speed of the compressor 772 of the heat pump 770, may control the operation of the heat pump 770 and the first water pump 780 and turn off the heat exchanger 771 and water circulation once a desired target water temperature in the insulated water tank 720 is reached. The heat pump 770 and water circulation can also be turned off manually once the desired target water temperature in the insulated water tank 720, based on the reading of the temperature detector 748, is reached. The insulated water tank 720 is now in its dispensing mode, ready to supply the cooled water to a user via the second outlet 900, such as a spout or a faucet. When the water in the insulated water tank 720 is partially or fully depleted, the water mixing system 700 can be switched back to the filling mode.

Due to heat exchange between the insulated water tank 720 and the environment, the cooled water in the insulated water tank 720 may be warmed up over time. When the temperature of the water in the insulated water tank 720 rises above a preset upper limit, the water mixing system 700 may be switched to the cooling mode to cool the water present inside the tank or to the filling mode to replace the consumed water and then to the cooling mode, depending on the user preference.

When the water mixing system 700 further comprises the cooled water tank 740, water consumed by the user from the insulated water tank 720 can be advantageously replenished without turning on the heat exchanger 771, by mixing stored cooled water from the cooled water tank 740, delivered by way of the third water pump 980 from the inlet 742 of the cooled water tank 740 to the second inlet 731 of the insulated water tank 720, with the ambient temperature water from the existing plumbing system 712 to obtain mixed water of a desirable temperature. The mixing can be done either manually, or automatically when the second inlet 731 and first inlet 722 for the ambient temperature water are both controlled by solenoid valves which are regulated by a controller operating in a similar fashion to the controller 64 of FIG. 1 for the first dispensing water tank 40 described in the first aspect of the present disclosure, i.e. the controller regulates the mixing ratio of the cooled water from the cooled water tank 740 to the ambient temperature water from the existing plumbing system 712 based on the target temperature of the mixed water in the insulated water tank 720 set by a temperature setter, the actual temperature of the mixed water in the insulated water tank 720 detected by the temperature detector 748, and the water level detected by the float 730, so that the mixed water in the insulate water tank 720 reaches a desirable target temperature.

Alternatively, when water cooler than the water stored in the cooled water tank 740 is preferred to be mixed with the ambient temperature water in the insulated water tank 720, for example, to replenish cooled water faster or have the mixed water with a lower temperature in the insulated water tank 720, the second water pump 880, the heat exchanger 771, and the first water pump 780 may be turned on to allow the stored cooled water in the cooled water tank 740 to be cooled even further by the heat exchanger 771, with the colder water exiting the heat exchanger 771 with a water temperature of, for example, 4-50° C., 4-30° C., or 10-20° C. fed to the insulated water tank 720 via the connecting pipe and the second inlet 731.

Although particular embodiments have been shown and described, it will be understood that they are not intended to limit the present inventions, and it will be obvious to those skilled in the art that various changes and modifications may be made without departing from the spirit and scope of the present inventions. The specification and drawings are, accordingly, to be regarded in an illustrative rather than restrictive sense. The present disclosure is intended to cover alternatives, modifications, and equivalents, which may be included within the spirit and scope of the present inventions as defined by the claims.

The invention claimed is:

1. A water mixing system, for attaching to an existing plumbing system having a supply of ambient temperature water, and providing temperature regulated water to a user, comprising:

an insulated water tank having a first inlet to receive the supply of ambient temperature water, a valve attached to the first inlet of the insulated water tank for altering a water flow therefrom, a first heat pump connected to the insulated water tank, wherein the first heat pump is a gas absorption heat pump having an absorber, a generator, a first heat rejecting radiator and a heat absorbing radiator, wherein the first heat rejecting radiator is located inside the insulated water tank to heat water inside the insulated water tank and the heat absorbing radiator is located outside the insulated water tank, a first temperature detector for detecting the temperature of the water inside the insulated water tank, a first outlet attached to the insulated water tank, wherein the first outlet is connected to a first dispensing water tank via a hot water inlet, wherein the first dispensing water tank has a tank bottom and a tank interior capable of holding water and is attached to the existing plumbing system via a cold water inlet to receive the supply of ambient temperature water, a pair of valves attached to the hot water inlet and the cold water inlet for altering a water flow therefrom and adjusting the temperature of water in the first dispensing water tank, a second temperature detector for detecting the temperature of the water in the first dispensing water tank, and a plurality of outlets attached to the first dispensing water tank, wherein at least one of the outlets is for dispensing the water to the user, wherein the first dispensing water tank further comprises a desired temperature control for allowing the user to set a desired water temperature, and wherein the pair of valves attached to the hot water inlet and the cold water inlet are solenoid valves which automatically adjust the water flow through the hot water inlet and the cold water inlet to achieve the desired water temperature within the first dispensing water tank.

2. The water mixing system of claim 1, wherein the first dispensing water tank further comprises a water level indicator for indicating a water level inside of the first dispensing water tank to the user.

3. The water mixing system of claim 1, wherein the plurality of outlets attached to the first dispensing water tank includes at least one side outlet which is located above the tank bottom of the first dispensing water tank, so that the at least one side outlet allows a reserve supply of water to collect in the first dispensing water tank which cannot be drained by the at least one side outlet.

4. The water mixing system of claim 3, wherein the plurality of outlets includes at least one outlet which is located at the tank bottom of the first dispensing water tank that is capable of draining the reserve supply from the first dispensing water tank.

5. The water mixing system of claim 1, further comprising a first water pump for delivering water from the first dispensing water tank to the insulated water tank and at least one pipe for connecting the first dispensing water tank to the insulated water tank.

6. The water mixing system of claim 5, further comprising a control for operating the first dispensing water tank in a reheat mode at which water from the first dispensing water tank is returned to the insulated water tank to be reheated through the first water pump and the at least one pipe, wherein the control monitors the temperature of the water in the first dispensing water tank, and wherein the control operates the first water pump to return the water in the first dispensing water tank to the insulated water tank when the temperature of the water in the first dispensing water tank is below a pre-determined level.

7. The water mixing system of claim 6, wherein the control further opens the hot water inlet of the first dispensing water tank to add water from the insulated water tank to the first dispensing water tank, and wherein the control stops operation of the first water pump and closes the hot water inlet of the first dispensing water tank when the temperature of the water in the first dispensing water tank reaches or exceeds the pre-determined level.

8. The water mixing system of claim 1, further comprising a second water pump for delivering water from the first dispensing water tank to a heat exchanger that heats the water, and at least one pipe for connecting the first dispensing water tank to the heat exchanger.

9. The water mixing system of claim 8, wherein the heated water from the heat exchanger is delivered to the first dispensing water tank.

10. The water mixing system of claim 8, wherein the heat exchanger comprises a second heat rejecting radiator of the first heat pump connected to the insulated water tank.

11. The water mixing system of claim 8, further comprising:

a control for operating the first dispensing water tank in a reheat mode at which water from the first dispensing water tank is brought to the heat exchanger to be reheated through the second water pump and the at least one pipe, wherein the control monitors the temperature of the water in the first dispensing water tank, wherein the control operates the second water pump to pass the water in the first dispensing water tank to the heat exchanger when the temperature of the water in the first dispensing water tank is below a pre-determined level, and wherein the control stops operation of the second water pump and/or the heat exchanger when the temperature of the water in the first dispensing water tank reaches or exceeds the pre-determined level.

12. The water mixing system of claim 1, further comprising a second dispensing water tank, wherein the second dispensing water tank has a first inlet connected to one of the plurality of outlets attached to the first dispensing water tank to receive water from the first dispensing water tank, and wherein the second dispensing water tank has a second inlet attached to the existing plumbing system to receive the supply of ambient temperature water and at least one outlet for dispensing water within the second dispensing water tank to the user.

13. The water mixing system of claim 12, wherein the second dispensing water tank is further connected to the insulated water tank via at least one pipe to receive water from the insulated water tank.

* * * * *